US008456495B2

(12) United States Patent
Fujiwara et al.

(10) Patent No.: US 8,456,495 B2
(45) Date of Patent: Jun. 4, 2013

(54) POWER CONTROL METHOD OF LIGHT EMITTING DEVICE FOR IMAGE DISPLAY, LIGHT EMITTING DEVICE FOR IMAGE DISPLAY, DISPLAY DEVICE AND TELEVISION RECEIVER

(75) Inventors: Kohji Fujiwara, Osaka (JP); Takayuki Murai, Osaka (JP); Tomohiko Yamamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 323 days.

(21) Appl. No.: 13/063,790

(22) PCT Filed: Jul. 17, 2009

(86) PCT No.: PCT/JP2009/062946

§ 371 (c)(1),
(2), (4) Date: Mar. 14, 2011

(87) PCT Pub. No.: WO2010/041504

PCT Pub. Date: Apr. 15, 2010

(65) Prior Publication Data

US 2011/0157262 A1 Jun. 30, 2011

(30) Foreign Application Priority Data

Oct. 10, 2008 (JP) ..... 2008-264292

(51) Int. Cl.
*G09G 5/10* (2006.01)
*G09G 3/36* (2006.01)

(52) U.S. Cl.
USPC ..... 345/691; 345/102; 345/82

(58) Field of Classification Search
USPC ..... 345/102, 76–83, 211, 690, 691
See application file for complete search history.

(56) References Cited

U.S. PATENT DOCUMENTS

| | | | | |
|---|---|---|---|---|
| 6,380,943 | B1 | 4/2002 | Morita et al. | |
| 2004/0114396 | A1 * | 6/2004 | Kobayashi et al. | 362/561 |
| 2005/0184952 | A1 | 8/2005 | Konno et al. | |
| 2006/0066533 | A1 | 3/2006 | Sato et al. | |
| 2006/0120082 | A1 | 6/2006 | Choo et al. | |
| 2007/0030697 | A1 | 2/2007 | Kim | |

(Continued)

FOREIGN PATENT DOCUMENTS

| | | | |
|---|---|---|---|
| CN | 101021999 | A | 8/2007 |
| EP | 1 750 248 | A2 | 2/2007 |

(Continued)

OTHER PUBLICATIONS

Official Communication issued in International Patent Application No. PCT/JP2009/062946, mailed on Oct. 13, 2009.

(Continued)

*Primary Examiner* — Jimmy H Nguyen
(74) *Attorney, Agent, or Firm* — KEating & Bennett, LLP

(57) ABSTRACT

In a method of controlling power of a light emitting device for image display that irradiates illumination light from divided regions, light emission brightness data of each light emitting element of the light emitting device is determined based on image data for image display (S20). Power in each region and total light emission power are computed based on the light emission brightness data of each light emitting element for each region (S40). If the computed total light emission power exceeds predetermined allowable power, the power in each region is limited so that the total light emission power is equal to or less than the predetermined allowable power (S50).

24 Claims, 9 Drawing Sheets

U.S. PATENT DOCUMENTS

| | | | | |
|---|---|---|---|---|
| 2007/0126672 | A1* | 6/2007 | Tada et al. | 345/77 |
| 2007/0152926 | A1 | 7/2007 | Kwon | |
| 2008/0111502 | A1 | 5/2008 | Kim et al. | |
| 2009/0115766 | A1 | 5/2009 | Stessen et al. | |

FOREIGN PATENT DOCUMENTS

| | | | |
|---|---|---|---|
| JP | 2001-022318 | A | 1/2001 |
| JP | 2002-108305 | A | 4/2002 |
| JP | 2004-350179 | A | 12/2004 |
| JP | 2005-249891 | A | 9/2005 |
| JP | 2005-258403 | A | 9/2005 |
| JP | 2006-091681 | A | 4/2006 |
| JP | 2006-119465 | A | 5/2006 |
| JP | 2007-183608 | A | 7/2007 |
| JP | 2008-233830 | A | 10/2008 |
| RU | 2 310 925 | C1 | 11/2007 |
| TW | 200811825 | A | 3/2008 |
| WO | 2007/132370 | A1 | 11/2007 |

OTHER PUBLICATIONS

English translation of Official Communication issued in corresponding Russian Patent Application No. 2011113327, mailed on Feb. 27, 2012.

* cited by examiner

POWER CONTROL METHOD OF LIGHT EMITTING DEVICE FOR IMAGE DISPLAY, LIGHT EMITTING DEVICE FOR IMAGE DISPLAY, DISPLAY DEVICE AND TELEVISION RECEIVER

TECHNICAL FIELD

The present invention relates to a power control method of light emitting device for image display, a light emitting device for image display, a display device and a television receiver, and more particularly relates to a control method of limiting power of the light emitting device for image display.

BACKGROUND ART

Power control (brightness control) of a backlight device including a CCFL (cold cathode fluorescent tube) that is used as a lighting device of a liquid crystal display device such as a liquid crystal television is executed based on APL values (average picture brightness level).

In recent years, there has been known a backlight device including a plurality of LEDs (light emitting diodes). There has been also known a region control backlight device including lighting means that divides illumination light from the LED backlight device into a plurality of regions and irradiates it (for example, refer to Patent Document 1). Such a region control backlight device controls the illumination light for each divided region.

[Patent Document 1] Japanese Unexamined Patent Publication No. 2005-258403

PROBLEM TO BE SOLVED BY THE INVENTION

However, in the power control of the region control backlight device, there may be no relative relation between the backlight device power and the APL value in some method of determining the region brightness. That is, the actual backlight power may not be equal to the power obtained by the power control based on the APL value. Therefore, in some cases, the power control, especially, the power limit control of the region control backlight device may not be executed appropriately based on the APL values. For example, the brightness of each region is determined by the maximum brightness value in the display pattern to obtain a peak brightness of the display image. In such a case, if the display image is formed by the repetition of the rectangular patterns having high brightness only in the middle portion, the backlight power increases compared to the power control based on the APL value. Therefore, in such a case, the limit control of the backlight power cannot be executed by the determination based on the APL value.

For power saving and prevention of heat generation, a predetermined allowable value (limit value) is normally set for power consumption of the backlight device. The power limit control is executed to use the backlight device with power consumption within a predetermined allowable range. However, a backlight device (a light emitting device for image display) is desired to provide illumination that enables sharp image display having peak brightness even if the power limit control is executed.

DISCLOSURE OF THE PRESENT INVENTION

The present invention was made in view of the foregoing circumstances. An object of the present invention is to provide a power control method of a lighting device for image display and a lighting device for image display that executes power limit control properly and enables image display having peak brightness within a predetermined allowable power range. Another object of the present invention is to provide a display device including such a lighting function and a television receiver including such a display device.

MEANS FOR SOLVING THE PROBLEM

To solve the above problem, in a light emitting device for image display that irradiates light from a plurality of divided regions and includes a plurality of light emitting units having at least one light emitting element, a method of controlling power of the light emitting device according to the present invention includes a light emission brightness data determination step for determining light emission brightness data of each light emitting element based on image data for image display and a light emitting element control step for executing a plurality of light emitting element control processes relating to each light emitting element based on the light emission brightness data. The light emitting element control step includes a power computation process step for computing power in each region and total light emission power based on light emission brightness data of each light emitting element in each region and a power limit process step for limiting the power in each region if the computed total light emission power exceeds predetermined allowable power so that the total light emission power is equal to the predetermined allowable power or less.

According to the present invention, a light emitting device for image display irradiating light from divided regions, the light emitting device includes a plurality of light emitting units each corresponding to each of the regions and having at least one light emitting element, a region driving circuit configured to determine light emission brightness data of each light emitting element based on image data for image display, and a light emitting element control circuit configured to execute light emission control processes relating to each light emitting element based on the light emission brightness data. The light emitting element control circuit includes a power computation circuit configured to execute a power computation process for computing power in each region and total light emission power based on the light emission brightness data of each light emitting element for each region and a power limiter circuit configured to execute a power limit process if the computed total light emission power exceeds predetermined allowable power, the power limit process limiting power in each region so that the total light emission power is equal to the predetermined allowable power or less.

According to the method and the configuration of the device, the light emission power is computed for each region and the total light emission power is computed based on the total of the light emission power for each region. If the computed total light emission power exceeds the predetermined allowable power, the power in each region is limited so that the total light emission power is equal to or less than the predetermined allowable power. Therefore, if the light emission power is controlled for each region, the power limit control is properly executed. Further, since the light emission brightness data for each region that is power for each region is determined based on image data corresponding to each region, power is determined for each region within the predetermined allowable power range. This enables image display having peak brightness within the predetermined allowable power range. It is noted that the word of "for image display" is referred to include that the light emitting device displays an image and that the light emitting device makes other device to display an image.

BEST MODE FOR CARRYING OUT THE INVENTION

One embodiment of the present invention will be explained with reference to FIGS. 1 to 8. In the present embodiment, a television receiver TV including a liquid crystal display device 10 will be explained. Each of an X-axis, a Y-axis and a Z-axis is illustrated to have a common direction in each drawing.

1. Structure of Television Receiver

Figure 1:
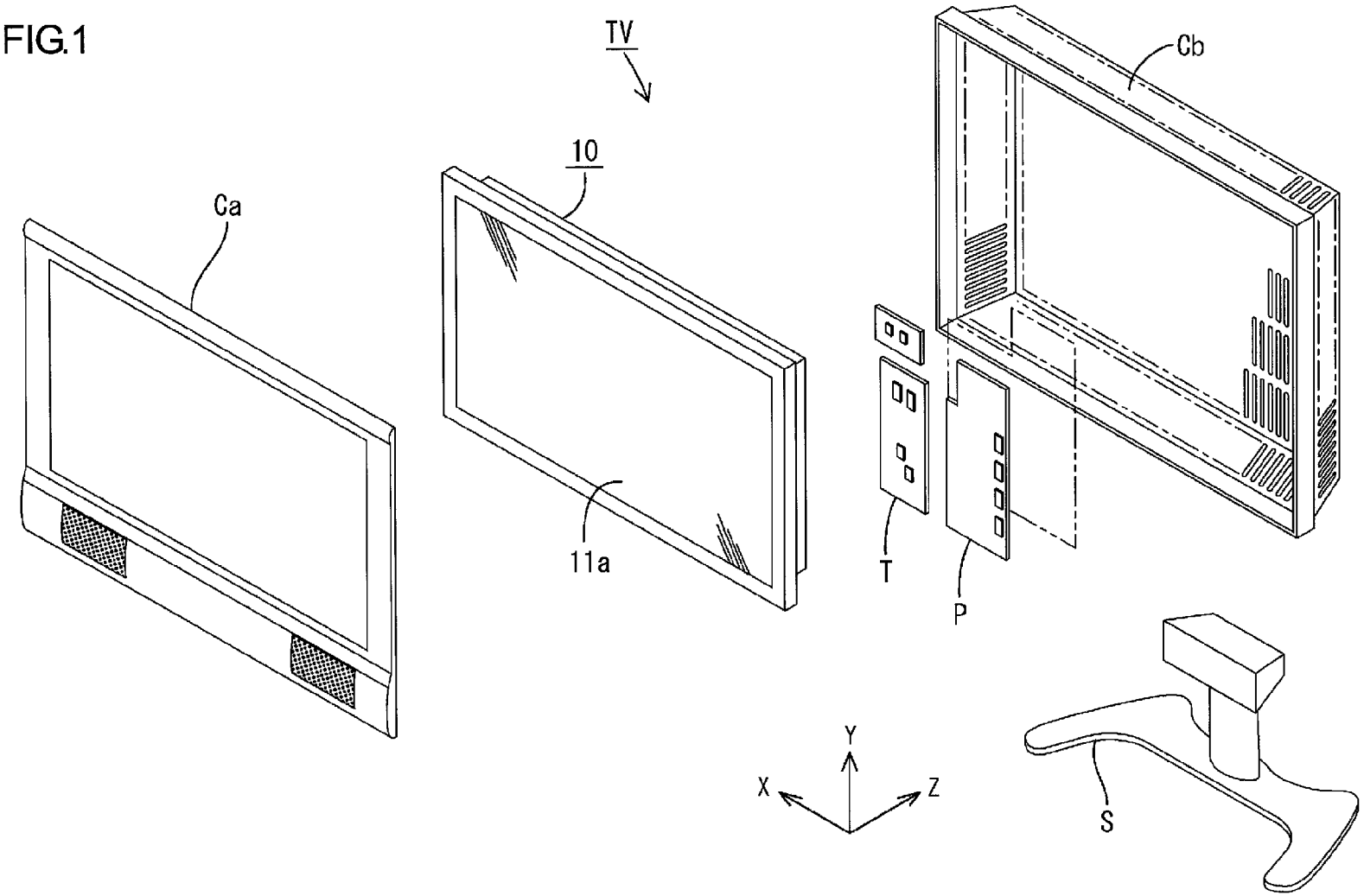
FIG. 1 is an exploded perspective view illustrating a general construction of a television receiver according to an embodiment of the present invention.

As illustrated in FIG. 1, the television receiver TV of the present embodiment includes the liquid crystal display device 10 (an example of a display device), front and rear cabinets Ca, Cb that house the liquid crystal display device 10 therebetween, a power source P and a tuner T. The liquid crystal display device 10 is supported by a stand S such that a display surface 11*a* is parallel to a vertical direction (Y-axis direction). The display device of the present invention may be applied to the liquid crystal display device for color display and also to the liquid crystal display device for black and white display. The display device is not limited to a liquid crystal display device but may be any devices that have a lighting device and control brightness of the lighting device within a predetermined allowable power range.

2. Construction of Liquid Crystal Display Device

Figure 2:
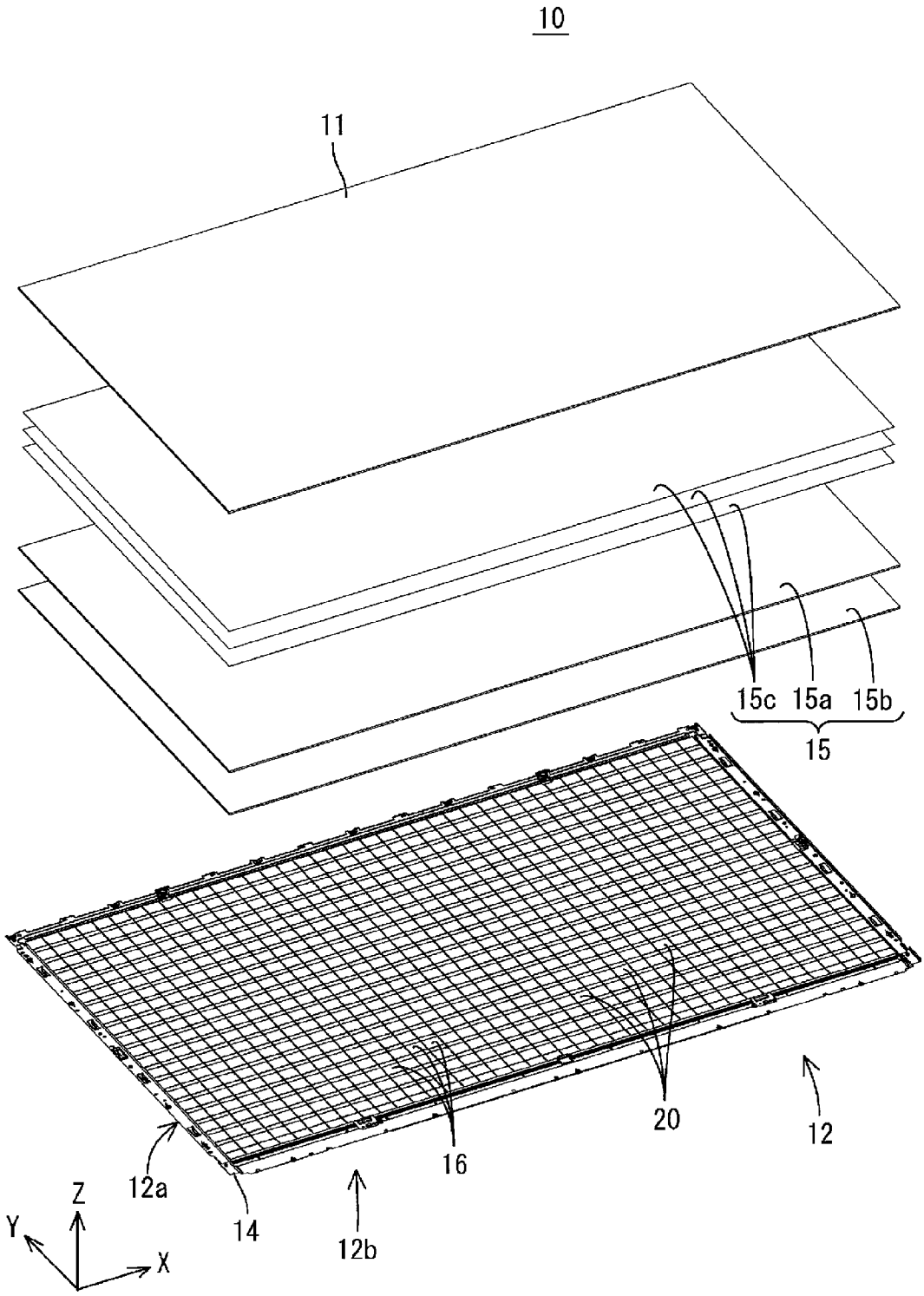
FIG. 2 is an exploded perspective view illustrating a general construction of a liquid crystal panel and a backlight device.

An overall shape of the liquid crystal display device 10 is a landscape rectangular. As illustrated in FIG. 2, it includes a liquid crystal panel 11 as a display panel, and a backlight device 12 (lighting device and a light emitting device for image display). They are integrally held by a bezel and the like. The liquid crystal display device 10 further includes a display control section 30 (refer to FIG. 3).

Next, the liquid crystal panel (LDC panel) 11 and the backlight device 12 will be explained. The liquid crystal panel 11 is formed in a rectangular shape with a plan view and constructed such that a pair of glass substrates is bonded together with a predetermined gap therebetween and liquid crystal is sealed between the glass substrates.

On one of the glass substrates, switching components (e.g., TFTs (thin film transistors)) connected to source lines and gate lines that are perpendicular to each other, pixel electrodes connected to the switching components, and an alignment film are provided. On the other substrate, a color filter having color sections such as R (red), G (green) and B (blue) color sections arranged in a predetermined pattern, common electrodes, and an alignment film are provided.

With such a construction, for example, color pixels of 192*1080 dots for high vision are formed in the liquid crystal panel 11. Further, an LCD driver and an LCD controller are provided in the liquid crystal panel 11 to control the switching element of each pixel.

As illustrated in FIG. 2, the backlight device 12 irradiates and illuminates a rear side of the liquid crystal panel 11 with light from divided regions. The backlight device 12 includes a LED panel 12*b* and an optical member 15. The optical member 15 is configured by a diffuser plates 15*a*, 15*b* and optical sheets 15*c*.

The LED panel 12*b* includes a plurality of light emitting units 20 each of which corresponds to each region, and each light emitting unit 20 includes an LED section 16. Each LED section 16 includes an R (red) light emitting diode DR, a G (green) light emitting diode DG and a B (blue) light emitting diode DB (refer to FIG. 4). An irradiating surface 12*a* of the backlight device 12 is divided into a plurality of regions by the light emitting units 20. According to the present embodiment, the light emitting units 20 configure the divided regions of the backlight device 12. As illustrated in FIG. 2, for example, the irradiating surface 12*a* is divided into 20*40 (800) regions. The number of light emitting units 20 and the number of divided regions in the irradiating surface 12*a* is arbitrarily set.

Figure 3:
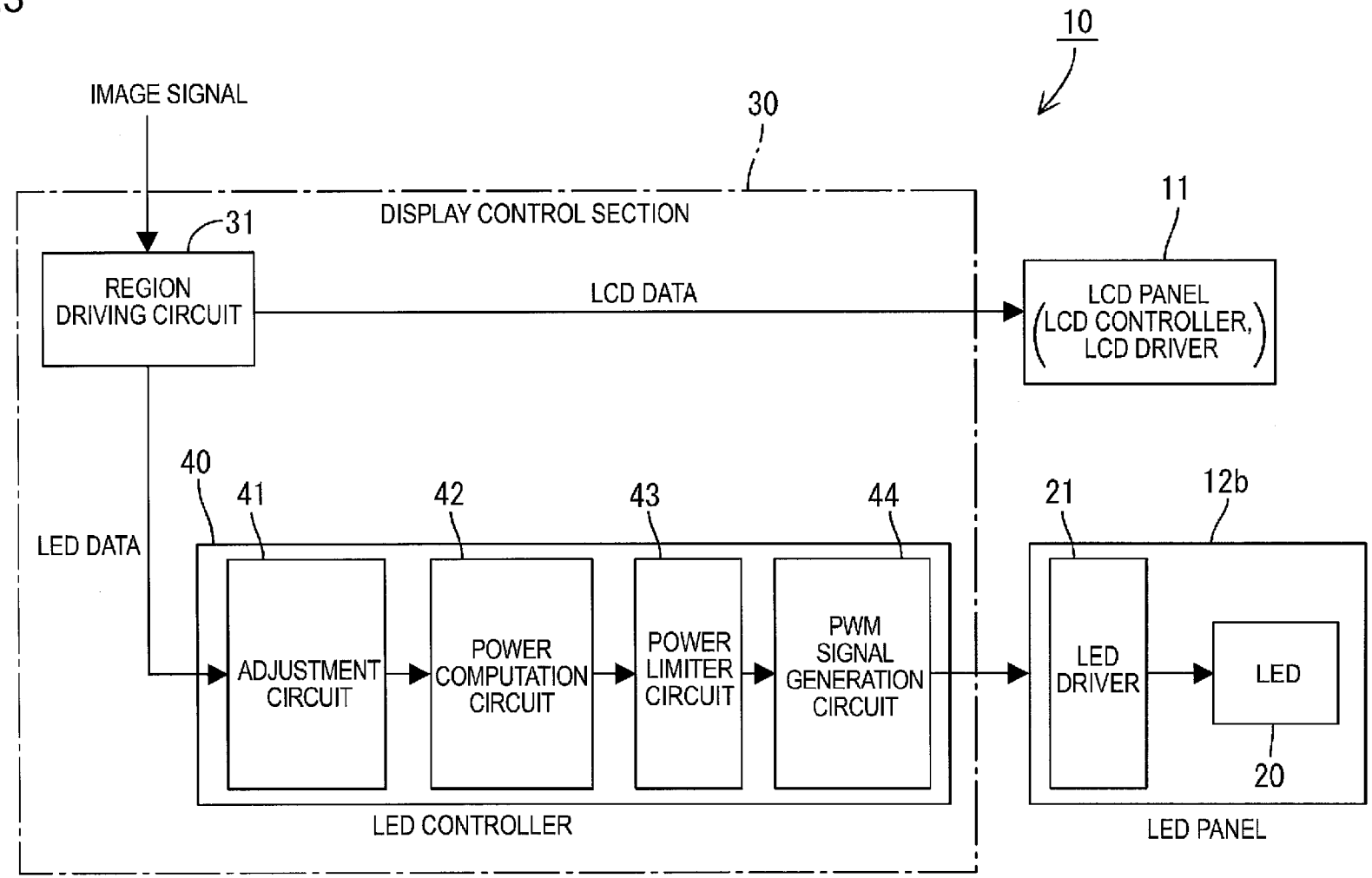
FIG. 3 is a block diagram illustrating a general electrical configuration of a liquid crystal display device.

The liquid crystal display device 10 further includes a display control section 30 as illustrated in FIG. 3. The display control section 30 includes a region driving circuit 31 and an LED controller (light emitting element control circuit) 40.

The region driving circuit 31 receives an image signal (image data) from the tuner T, for example, and determines light emitting brightness data (hereinafter referred to as LED data) of each light emitting diode based on the image signal. The region driving circuit 31 supplies the LED data to the LED controller 40 as a 12-bit digital signal. In the present embodiment, each light emitting diode is controlled by a PWM (pulse-width modulation) signal. Therefore, the LED data includes data relating to a PWM value (duty ratio) of the PWM signal. That is, the LED data includes PWM generation data (for example, 12-bit digital data) for generating the PWM signal. Further, the region driving circuit 31 generates LCD data that represents light transmittance data of each pixel in the LCD panel 11 based on the image signal and supplies the LCD data to the LCD panel 11.

The LED controller 40 includes an adjustment circuit 41, a power computation circuit 42, a power limiter circuit 43 and a PWM signal generation circuit 44. The adjustment circuit 41 receives LED data from the region driving circuit 31 and makes adjustments on the LED data such as white balance adjustment, temperature correction and the like.

The power computation circuit 42 computes light emission power in each region based on the adjusted LED data and executes a power computation process for computing total light emission power based on a total of light emission power in each region.

If the total light emission power that is computed by the power computation circuit 42 exceeds the predetermined allowable power, the power limiter circuit 43 executes a power limit process that limits power in each region so that the total light emission power is equal to or less than the predetermined allowable power.

As described above, each light emitting diode is controlled by the PWM signal supplied from the LED controller 40, and the consumption power of each light emitting diode is substantially proportional to the PWM value (duty ratio) of the PWM signal. Therefore, in the present embodiment, power is computed as a PWM value (%) based on PWM generation data in the power computation process and the power limit process.

The PWM signal generation circuit 44 generates a PWM signal having a PWM value that is limited by the power limit process and supplies the PWM signal to an LED driver 21 of the LED panel 12*b*.

Further, the LED controller 40 generates a driver control signal CNT that controls the LED driver 21 provided in the LED panel 12*b*, and supplies the driver control signal CNT to the LED driver 21.

Figure 4:
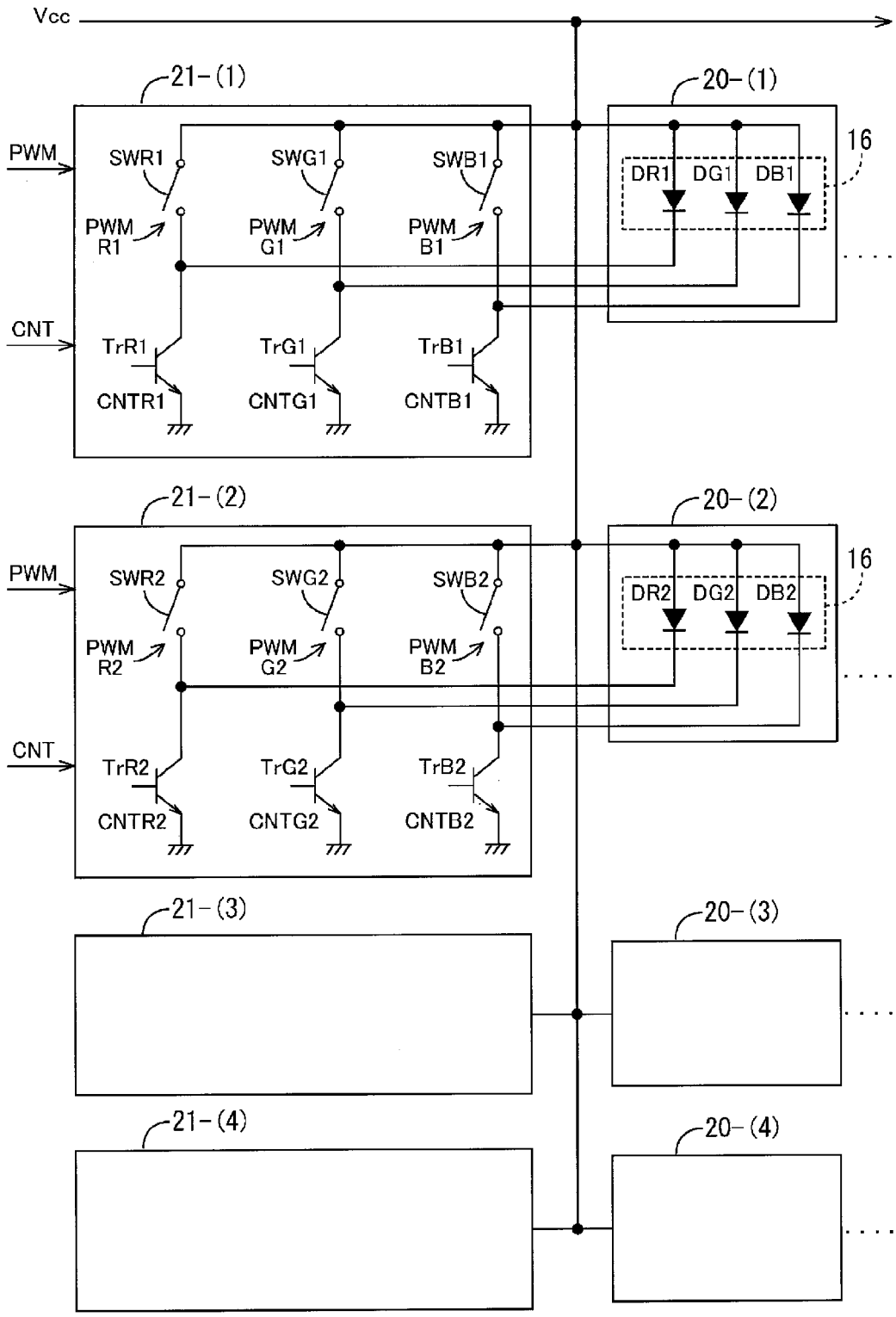
FIG. 4 is a circuit diagram explaining an electrical configuration of an LED panel.

In the present embodiment, for example, the LED driver 21 is provided for each light emitting unit 20 as illustrated in FIG. 4. As illustrated in FIG. 4, each LED driver 21 includes switching elements SW and current control transistors Tr each corresponding to each light emitting diode of the light emitting unit 20. Each switching element SW is controlled by a PWM signal supplied from the LED controller 40. Each current control transistor Tr is controlled by a CNT signal supplied from the LED controller 40. The current control transistor Tr is not limited to a bipolar transistor but may be a FET (field-effect transistor) for example.

In FIG. 4, each light emitting unit 20 includes a red light emitting diode DR1, a green light emitting diode DG1 and a blue light emitting diode DB1 as light emitting diodes. According to such a configuration, in each of the R light emitting diode, the G light emitting diode and the B light emitting diode included in the light emitting unit 20, the power consumption is separately controlled by the corresponding separate PWM signal.

The configuration of the light emitting diode included in the light emitting unit (divided region) 20 is not limited to the one illustrated in FIG. 4. For example, the light emitting unit may include only white light emitting diodes, or may include six light emitting diodes including two for each of the colors R (reed), G (green) and B (blue). The light emitting unit may have any configuration as long as each light emitting diode included in the light emitting unit 20 is configured so that the power consumption is controlled separately by a corresponding independent PWM signal.

3. Power Limit Control of Backlight Device

Figure 5:
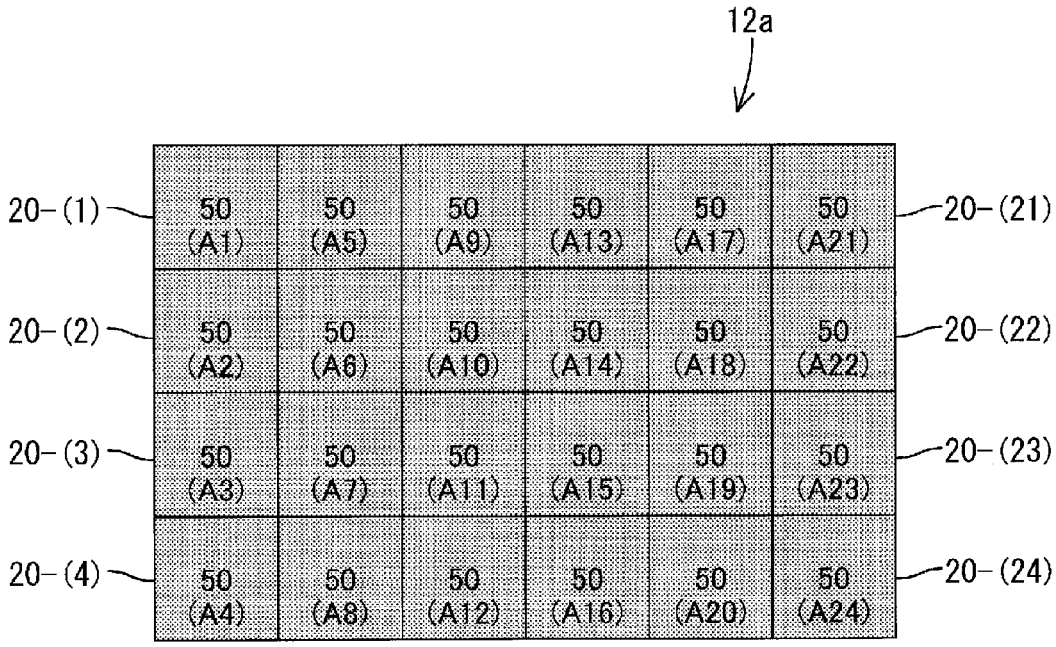
FIG. 5 is an explanation view illustrating predetermined allowable power of the LED panel.
Figure 6:
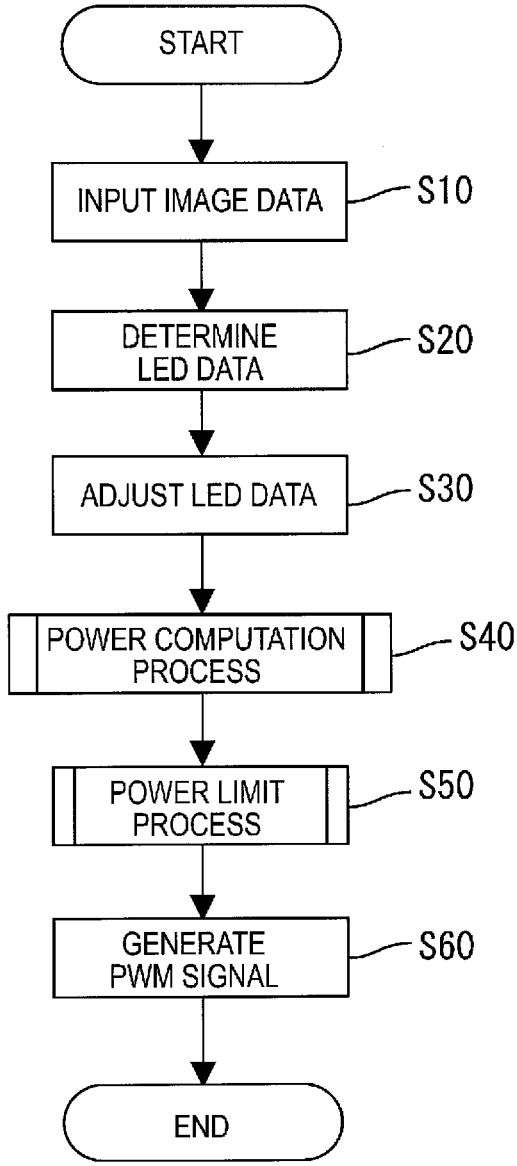
FIG. 6 is a flowchart illustrating a general flow of each process relating to power control of a backlight device.
Figure 7:
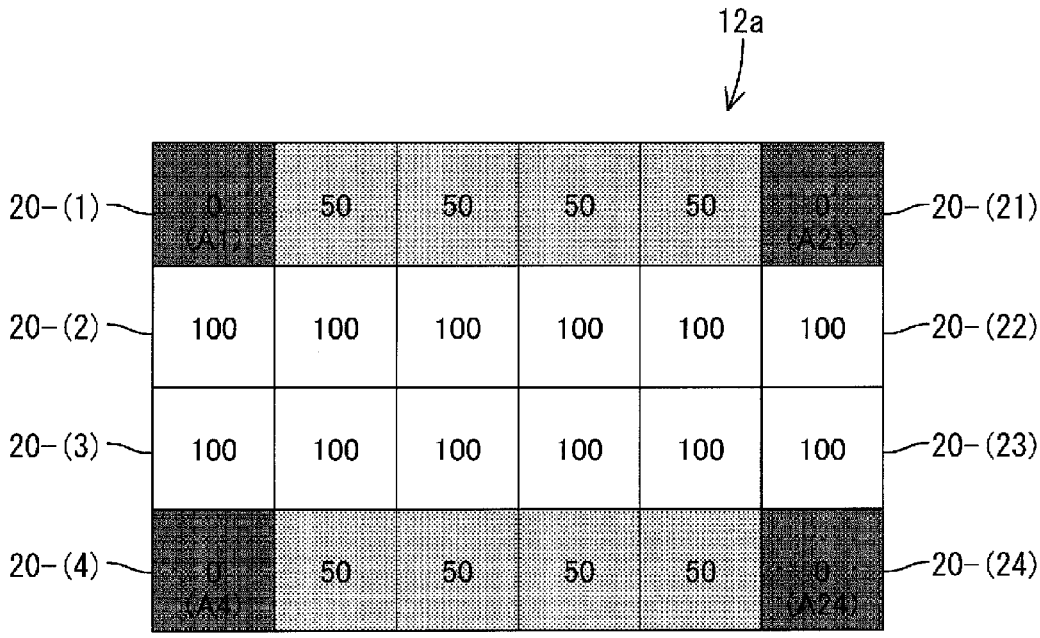
FIG. 7 is an explanation view illustrating power in each region of the LED panel before the power control process.
Figure 8:
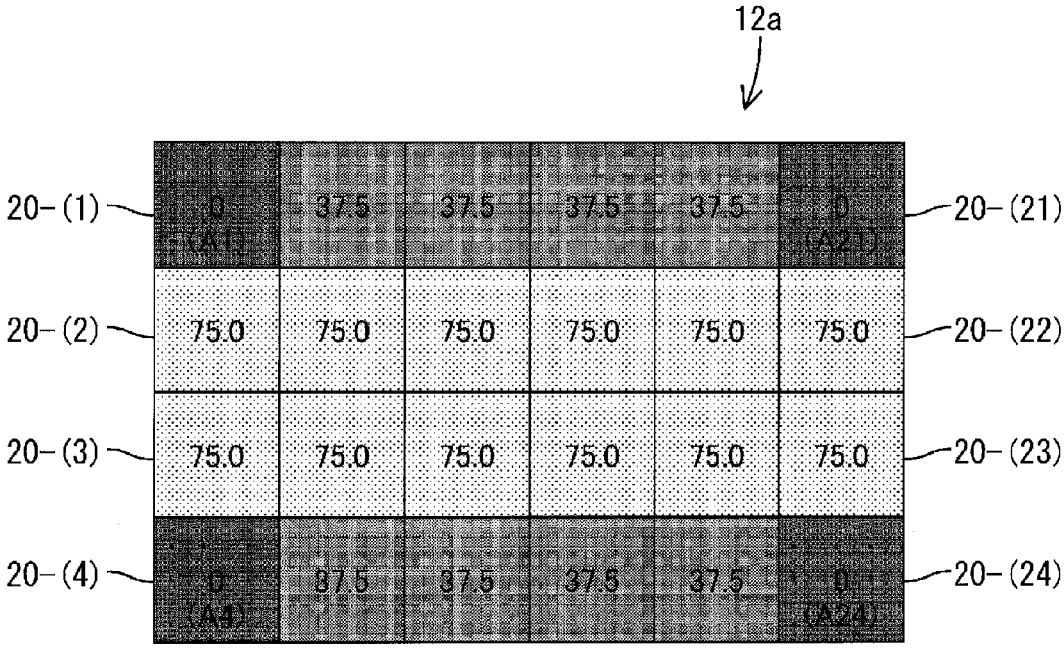
FIG. 8 is an explanation view illustrating power in each region of the LED panel after the power control process.

Next, a power limit control method of the backlight device 12 will be explained with reference to FIGS. 5 to 8. FIG. 5 is an explanation view of an irradiating surface 12*a* illustrating examples of predetermined limit power (allowable power). FIG. 6 is a flowchart illustrating a general flow of each process relating to power limit control. Each process is executed by the region driving circuit 31 and the LED controller 40 of the display control section 30 in the present embodiment. FIG. 7 is an explanation view illustrating the irradiating surface 12*a* before execution of the power limit control of the present embodiment. FIG. 8 is an explanation view illustrating the irradiating surface 12*a* after execution of the power limit control.

In FIGS. 5, 7 and 8, for simple explanation, the irradiating surface 12*a* of the backlight device 12 is divided into 24 regions from a region A1 to a region A24. A method of dividing the irradiating surface 12*a*, for example, the plane shape of the divided region is not limited to the one illustrated in FIGS. 5, 7 and 8. For example, an area and a shape of each divided region may be different from each other. The irradiating surface 12*a* may be divided into a plurality of regions in any methods or forms as long as power of each light emitting element in each divided region is controlled independently from each other.

For example, as illustrated in FIG. 5, the allowable power (limit power) is set such that the power of the backlight device 12 is limited to be 50% of the possible supply power when the LCD panel 11 displays white on the entire display screen. In such a case, power of each region, that is power of each light emitting diode is limited to be 50% of the maximum power. In other words, the PWM value (duty ratio) of each light emitting diode is limited to be 50%. In the following, for simple explanation, each light emitting diode is controlled to have a same PWM value (%).

In the process of power limit control, at step S10 in FIG. 6, image data that is to be displayed by the liquid crystal display device 10 is input to the region driving circuit 31 of the display control section 30. Next, at step S20, the region driving circuit 31 determines a PWM value (%) that is LED data (light emitting brightness data) of each region (A1 to A24) based on the image data. Examples of the determined PWM values of each region (A1 to A24) are illustrated in FIG. 7. In FIG. 7, the determined PWM values include three kinds of PWM values of "0%", "50%" and "100%".

In the present embodiment, the PWM value of each region is determined based on the maximum value included in the image data corresponding to each region. Normally, pixels exist in the range of the LCD panel 11 corresponding to each region. Therefore, in the present embodiment, the PWM value of each region is determined based on the maximum value in a plurality of pixel data (brightness data).

The method of determining the PWM value in each region is not limited to the one explained above. For example, the PWM value in each region may be determined as follows. First, an average value of a predetermined number of pixel data corresponding to each region is computed and the PWM value in each region may be determined based on a maximum value of the average values. Or, the PWM value in each region may be determined based on an average value of all pixel data corresponding to each region. The PWM value in each region is determined every frame cycle of an image. The determination cycle of the PWM value is not limited to the frame cycle. For example, the determination cycle may be every five frames of an image or may be every thirty frames of an image. If the display image is a static image, the PWM value is determined only when the display image is changed.

Next, at step S30 in FIG. 6, the adjustment circuit 41 of the LED controller 40 receives the LED data (PWM generation data) from the region driving circuit 31 and makes adjustment on the LED data such as white balance adjustment and temperature correction.

Next, at step S40 in FIG. 6, the power computation circuit 42 of the LED controller 40 computes light emission power in each region based on the adjusted LED data (PWM generation data). Then, the power computation circuit 42 executes a power computation process to compute power of the backlight device 12. As described above, the PWM value (duty ratio) is proportional to the power. Therefore, the power computation process is executed with using the PWM value (o). For example, in case illustrated in FIG. 7, the total light emission power is 1600(%) and the average value in each region is 66.7%. In case illustrated in FIG. 5, the allowable power is 1200(%) and the average value in each region is 50%. Therefore, in case illustrated in FIG. 7, the total light emission power exceeds the allowable power.

At step S50 in FIG. 6, if the total light emission power computed by the power computation circuit 42 exceeds predetermined allowable power, the power limiter circuit 43 of the LED controller 40 executes a power limit process to limit power in each region so that the total light emission power is equal to the predetermined allowable power.

In the power limit process, the power limiter circuit 43 computes a limit ratio α that is a percentage of predetermined allowable power in the total light emission power. In the present embodiment, the limit ratio α is 0.75 that is obtained by 1200/1600 (50/66.7). The power in each region is multiplied by the limit ratio α to limit the power in each region. The power values (PWM values) in each region that are thus limited are illustrated in FIG. 8. The total light emission power in case in FIG. 8 is almost 1200(%) that is equal to the predetermined allowable power.

In such a case, as illustrated in FIG. 8, the PWM value is limited from 50(%) to 37.5(%) and from 100(%) to 75.0(%). However, the difference between the PWM values in each of the regions is maintained. Therefore, in the present embodiment, the total light emission power is set within the predetermined allowable power range (1200(%)). Also, in such a case, the power is limited for each region corresponding to the image data in each region. This enables the liquid crystal display device 10 to provide image display having peak brightness within a predetermined allowable power range.

In the above case, since it is supposed that the power of each of the R, G and B light emitting diodes of each region (light emitting unit) is equal to each other, the calculation method based on the power in every region is explained. The power computation method in the present embodiment is described by formulas relating to each of the colors R, G and B as follows.

*R* power amount(%)=total of red light emitting diode PWM values supplied to every region (formula 1)

*G* power amount(%)=total of green light emitting diode PWM values supplied to each region (formula 2)

*B* power amount(%)=total of blue light emitting diode PWM values supplied to every region (formula 3)

Power value of backlight device(total light emission power)=*R* power amount+*G* power amount+*B* power amount (formula 4)

Restriction ratio α=allowable power/total light emission power (formula 5)

Total limited light emission power=(*R* power amount+*G* power amount+*B* power amount) *α=allowable power (formula 6)

In the present embodiment, when computing the total light emission power, the power computation circuit 42 computes the power amount of each light emission color based on the total of light emission power of each light emission color in each region (formulas 1 to 3), and computes the total light emission power based on the total of the power amount of each light emission color (formula 4). The power limiter circuit 43 limits power in each region by multiplying the light emission power of each light emission color by the same limit ratio α (formula 5). In the formula 6, the total light emission power is multiplied by the limit ratio α in computing the total limited light emission power. If the limit ratio α for each light emitting diode is same, the computation formula for computing the total limited light emission power is same as the formula 6 when the light emission power of each light emitting color is multiplied by the same limit ratio α to compute the limit power in each region for each color and the total limited light emission power is obtained. It is not always required that the light emission power of each light emission color is multiplied by the same limit ratio α. A different limit ratio α may be set for light emission power of each light emission color if necessary.

Thus, in the present embodiment, the power computation process of step S40 and the power limit process of step S50 are executed at the final stage in the light emission control processes executed by the LED controller 40. Therefore, if light emission control processes relating to each light emitting element such as white balance adjustment and a temperature correction process are executed based on the light emission brightness data, the power limit process is executed after the light emission control processes. Therefore, compared to the case in that the power limit control is executed before the light emission control processes, the power limit process is less likely to be influenced by the light emission control processes. Thus, the power limit process is executed at the final stage in the light emission control process. Therefore, even if the PWM generation data is corrected before the power limit process, the desired power limit operation is executed based on the corrected PWM generation data.
The PWM value to which the power limit operation is executed is not required to be corrected to generate a PWM signal.

Next, at step S60, the PWM signal generation circuit 44 generates a PWM signal having a PWM value (duty ratio) that is limited by the power limit process illustrated in FIG. 8 and supplies the PWM signal to the LED driver (21-(1) to 21-(4)). Each LED driver 21 controls with PWM each switching element (SWR, SWG, SWB) according to the PWM signal (PWMR, PWMG, PWMB) corresponding to each color and emits light from the corresponding light emitting diode of each color (DR, DG, DB). In the configuration illustrated in FIG. 4, when each switching element is off and power from the DC power source VCC is supplied to each switching element, light is emitted from each light emitting diode. In the configuration illustrated in FIG. 4, when generating an actual PWM signal, the PWM signal generation circuit 44 generates a PWM signal having an inverse value of the PWM value (duty ratio) illustrated in FIG. 8. For example, if the PWM value illustrated in FIG. 8 is 37.48%, the PWM signal generation circuit 44 generates a PWM signal having the PWM value of 62.52%. Instead, without generating a PWM signal having an inverse value of the PWM value, a switching element that is turned off when a PWM signal is at a logical high level is used as the switching element.

4. Advantages of the Embodiment

According to the present embodiment, if the total light emission power computed for each region exceeds the predetermined allowable power, the power in each region is limited so that the total light emission power is within the predetermined allowable power range. Therefore, in a case that the light emission power is controlled for each region, the power limit control is appropriately executed for any kinds of display images. The light emission brightness data for each region that is the power in each region is determined based on the image data corresponding to each region. Therefore, power can be set and limited for each region within the predetermined allowable power range. Therefore, image display having peak brightness is enabled within the predetermined allowable power range.

The LED controller 44 executes the power limit process at the final stage. Therefore, even if the PWM generation data is corrected in the process prior to the power limit process, desired power limit operation is executed based on the corrected PWM generation data.

Since the light emission brightness data for each region (each light emitting element) is determined based on the maximum value of the image data corresponding to each region, the power control is executed on the condition that is severer than the actual state, that is, on the condition that the total light emission power easily exceeds the predetermined allowable power. Therefore, it is preferable in the case that power saving in the lighting device is strongly desired.

<Other Modifications>

The embodiments of the present invention have been described, however, the present invention is not limited to the above embodiments explained in the above description and the drawings. The following embodiments may be included in the technical scope of the present invention, for example.

Figure 9:
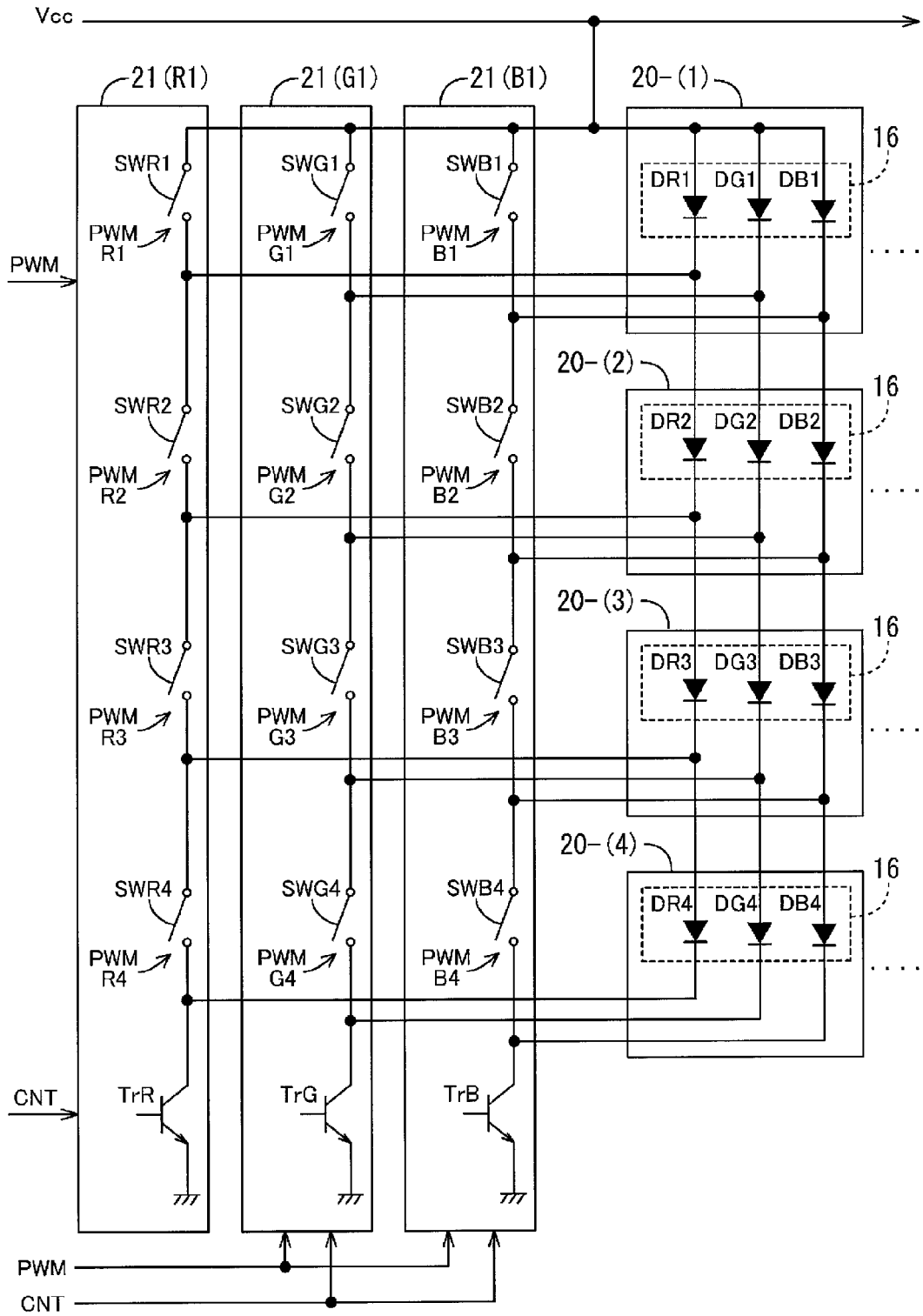
FIG. 9 is a circuit diagram illustrating another electrical configuration of the LED panel.

(1) In the above embodiment, the configuration of the LED drivers 21 and the light emitting diodes (light emitting units 20) is not limited to the one illustrated in FIG. 4. For example, as illustrated in FIG. 9, one LED driver 21 may drive the light emitting diodes that are connected to each other with cascade connection. In the example illustrated in FIG. 9, one LED driver 21 (R1) drives four red light emitting diodes (DR1 to DR4) that are connected to each other with cascade connection, and one LED driver 21 (G1) drives four green light emitting diodes (DG1 to DG4), and one LED driver 21 (B1) drives four blue light emitting diodes (DB1 to DB4). In such a case, the number of LED drivers 21 is reduced. The maximum one of the PWM values of the light emitting diodes that are connected to each other with cascade connection is determined to be the PWM value of each light emitting diode that is used for the power computation. If a PWM value of each of the red light emitting diodes DR1 to DR4 based on the image data is 20%, 50%, 60% and 10% respectively, the PWM value of each of the red light emitting diodes (DR1 to DR4) used for the power computation is set to 60%.

(2) In the above embodiment, the backlight device (lighting device, light emitting device for image display) 12 does not include the region driving circuit 31 and the LED controller 40 and they are included in the display control section 30 of the liquid crystal display device 10. However, the backlight device as an independent device may include the region driving circuit 31 and the LED controller 40. Also, in the liquid crystal display device 10, the backlight device 12 may include the LED controller 40.

(3) In the above embodiment, in computing the total light emission power, the total power (the power amount) of the light emitting diodes of each color is computed (refer to formula 1 to formula 4). The computation method is not limited thereto. For example, the total light emission power may be computed based on the total of power in each region. The total light emission power is computed in any methods as long as it is obtained based on the light emission brightness data (PWM generation data) of each light emitting element of each region.

(4) In the above embodiment, the power in each region is multiplied by the same limit ratio α (refer to formula 5) so that the power in each region is controlled to be within the predetermined allowable power range. However, the limit ratio α may be different for each region. Further, the power limit operation for each region may not be necessarily executed based on the limit ratio α. The power limit operation for each region may be executed in any methods as long as the total light emission power is within the predetermined allowable power range. For example, the power limit operation may be executed in different methods for each region based on the image data of each region.

(5) In the above embodiment, the predetermined allowable value of the power of the backlight device 12 is constant. However, the predetermined allowable value may be variable. For example, the predetermined allowable value may be determined in relation to a lowest value in the RBG power amounts (refer to formula 1 to formula 3).

Specifically, in obtaining the limit ratio α, the limit ratio (Rα, Gα, Bα) of each power amount of red, blue and green is obtained according to the following formulas (formula 5-1 to 5-3).

$$\text{limit ratio } R\alpha = R \text{ predetermined allowable value}/R \text{ power amount} \quad \text{(formula 5-1)}$$

$$\text{limit ratio } G\alpha = G \text{ predetermined allowable value}/G \text{ power amount} \quad \text{(formula 5-2)}$$

$$\text{limit ratio } B\alpha = B \text{ predetermined allowable value}/B \text{ power amount} \quad \text{(formula 5-3)}$$

A lowest value is selected from the limit ratios Rα, Gα, Bα as the limit ratio α that is to be used to obtain the total limited light emission power (refer to formula 6). The predetermined allowable values of red, green and blue may be equal to each other. The predetermined allowable value may be set to be different for each color of red, blue and green, and the lowest value is selected from the limit ratios Rα, Gα, Bα as the limit ratio α. The lowest value is selected from the limit ratios Rα, Gα, Bα as the limit ratio α that is to be used to obtain the total restriction light emission power. Therefore, even if the power amount is different for each color of red, blue green, the power amount is surely limited to be the predetermined allowable value or lower for each color and the total limited light emission power is limited to be the allowable power or less.

If power is supplied to the irradiating surface 12*a* of the backlight device 12 from a plurality of power sources, each power source may have a different predetermined allowable value and execute power limit control for each power source.

The predetermined allowable value may be varied according to the configuration of the LED driver 21 that is used. According to the LED driving method of the LED driver 21, the determination method of the PWM value of the light emitting diode in the power computation may be changed as described in another embodiment (1). Another embodiment (5) deals with such a case.

(6) In the above embodiment, the backlight device as the light emitting device for image display of the present invention is applied to the LED backlight device, however, it is not limited thereto. The light emitting element is not limited to the light emitting diode and may be another light emitting element such as an EL element.

(7) In the above embodiment, the light emitting device for image display of the present invention is applied to the backlight device 12 of the liquid crystal display device 10, however, it is not limited thereto. For example, the light emitting device for image display of the present invention can be applied to an LED type Aurora Vision (registered trademark).

The invention claimed is:

1. A method of controlling power of a light emitting device for image display irradiating light from a plurality of divided regions, the light emitting device including a plurality of light emitting units having at least one light emitting element, the method comprising:

a light emission brightness data determination step for determining light emission brightness data of each light emitting element based on image data for image display; and a light emitting element control step for executing a plurality of light emitting element control processes relating to each light emitting element based on the light emission brightness data, wherein the light emitting element control step includes:

a power computation process step for computing power in each region and total light emission power based on light emission brightness data of each light emitting element in each region; and a power limit process step for limiting the power in each region if the computed total light emission power exceeds predetermined allowable power so that the total light emission power is equal to the predetermined allowable power or less.

2. The method according to claim 1, wherein the power limit process step includes computing a limit ratio that is a percentage of the allowable power in the total light emission power and limiting power in each region by multiplying the power in each region by the limit ratio.

3. The method according to claim 2, wherein:

each of the light emitting units includes a plurality of light emitting elements emitting light of different colors;

the power computation process step includes computing a power amount of each light emission color and computing the total light emission power based on total of the power amounts of each light emission color; and the power limit process step includes multiplying the light emission power of each light emission color by the same limit ratio to limit the power in each region.

4. The method according to claim 1, wherein the power computation process step and the power limit process step are executed at a final stage in the light emission control processes of the light emitting element control process step.

5. The method according to claim 1, wherein the light emission brightness data determination step determines the light emission brightness data of each light emitting element based on a maximum value of image data of an object to be illuminated corresponding to the region.

6. The method according to claim 1, wherein:

the light emission brightness data includes PWM generation data that controls the light emission brightness of the light emitting element by a PWM signal;

each power is computed as a PWM value based on the PWM generation data in the power computation process step and the power limit process step; and the light emitting element control step further includes a PWM signal generation step for generating the PWM signal having the PWM value that is limited by the power limit process step.

7. The method according to claim 1, wherein the light emitting device is a backlight device that illuminates an object to be illuminated from its rear side to display an image.

8. The method according to claim 7, wherein the object to be illuminated is a liquid crystal display device.

9. A light emitting device for image display irradiating light from divided regions, the light emitting device comprising:

a plurality of light emitting units each corresponding to each of the regions and having at least one light emitting element;

a region driving circuit configured to determine light emission brightness data of each light emitting element based on image data for image display; and a light emitting element control circuit configured to execute light emission control processes relating to each light emitting element based on the light emission brightness data, wherein the light emitting element control circuit includes:

a power computation circuit configured to execute a power computation process for computing power in each region and total light emission power based on the light emission brightness data of each light emitting element for each region; and a power limiter circuit configured to execute a power limit process if the computed total light emission power exceeds predetermined allowable power, the power limit process limiting power in each region so that the total light emission power is equal to the predetermined allowable power or less.

10. The light emitting device according to claim 9, wherein the power limiter circuit computes a limit ratio that is a percentage of the allowable power in the total light emission power and multiplies the power in each region by the limit ratio to limit the power in each region.

11. The light emitting device according to claim 10, wherein:

each light emitting unit includes a plurality of light emitting elements emitting light of different colors;

the power computation circuit computes a power amount of each light emission color and computes the total light emission power based on total of the power amounts of each light emission color; and the power limiter circuit multiplies the light emission power of each light emission color by the same limit ratio to limit the power in each region.

12. The light emitting device according to claim 9, wherein the power computation process and the power limit process are executed at a final stage in the light emission control processes by the light emitting element control circuit.

13. The light emitting device according to claim 9, wherein the region driving circuit determines the light emission brightness data of each light emitting element based on a maximum value of image data of the object to be illuminated corresponding to the region.

14. The light emitting device according to claim 9, wherein:

the light emitting element is controlled to have certain light emission brightness by a PWM signal;

the light emission brightness data includes PWM generation data for generating the PWM signal; and the power computation process and the power limit process are executed based on a PWM value based on the PWM generation data, wherein the light emitting element control circuit further includes a PWM signal generation circuit configured to generate a PWM signal having the PWM value that is limited by the power limit process.

15. The light emitting device according to claim 9, wherein the light emitting device is a backlight device that illuminates an object to be illuminated from its rear side to display an image.

16. The light emitting device according to claim 15, wherein the object to be illuminated is a liquid crystal display device.

17. A display device controlling brightness of a lighting device in a predetermined allowable power range, the display device comprising:

a display panel including a plurality of display elements;

a lighting device configured to irradiate light from divided regions to illuminate the display panel from a rear side, the lighting device including a plurality of light emitting units each corresponding to each region and having at least one light emitting element; and a display control section configured to control the display panel and the lighting device, wherein:

the display control section includes:

a region driving circuit configured to determine the light emission brightness data of each light emitting element based on the image data on the display panel; and a light emitting element control circuit configured to execute a plurality of light emission control processes relating to each light emitting element, and the light emitting element control circuit includes:

a power computation circuit configured to execute a power computation process for computing power in each region and total light emission power based on the light emission brightness data of each light emitting element in each region; and a power limiter circuit configured to execute a power limit process for limiting power in each region so that the total light emission power is equal to the predetermined allowable power or less if the computed total light emission power exceeds the predetermined allowable power.

18. The display device according to claim 17, wherein the power limiter circuit computes a limit ratio that is a percentage of the allowable power in the total light emission power and multiplies the power in each region by the limit ratio to limit the power in each region.

19. The display device according to claim 18, wherein:

each light emitting unit includes a plurality of light emitting elements emitting light of different colors;

the power computation circuit computes a power amount of each light emission color and computes the total light emission power based on total of the power amounts of each light emission color; and the power limiter circuit multiplies the light emission power of each light emission color by the same limit ratio to limit the power in each region.

20. The display device according to claim 17, wherein the power computation process and the power limit process are executed at a final stage in the light emission control processes by the light emitting element control circuit.

21. The display device according to claim 17, wherein the region driving circuit determines the light emission brightness data of each light emitting element based on a maximum value of image data on the display panel corresponding to the region.

22. The display device according to claim 17, wherein:

the light emitting element is controlled to have certain light emission brightness by a PWM signal;

the light emission brightness data includes PWM generation data for generating the PWM signal; and the power computation process and the power limit process are executed based on a PWM value based on the PWM generation data, wherein the light emitting element control circuit further includes a PWM signal generation circuit configured to generate a PWM signal having the PWM value that is limited by the power limit process.

23. The display device according to claim 17, wherein the display panel is a liquid crystal panel.

24. A television receiver comprising the display device according to claim 17.

* * * * *